United States Patent [19]

Williams

[11] Patent Number: 4,928,615

[45] Date of Patent: May 29, 1990

[54] HATCH COVER

[76] Inventor: John E. Williams, 5727 Nakat Way, Blaine, Wash. 98230

[21] Appl. No.: 328,620

[22] Filed: Mar. 27, 1989

[51] Int. Cl.[5] ..... E05D 15/54

[52] U.S. Cl. ..... 114/203; 114/201 R; 292/36; 292/7; 292/256.5

[58] Field of Search ..... 114/201 R, 203, 116, 114/117, 320, 335; 220/314, 315; 244/129.4, 129.5; 292/36, 67, DIG. 31, 256.5, 46, 48, 221; 49/316, 317, 463; 217/76; 105/377

[56] References Cited

U.S. PATENT DOCUMENTS

| | | | |
|---|---|---|---|
| 255,017 | 3/1882 | Pond | 217/130 |
| 695,409 | 3/1902 | Mandt | 292/7 |
| 891,174 | 6/1908 | Hurlburt | 114/203 |
| 991,548 | 5/1911 | Schmid | 292/6 |
| 1,136,498 | 4/1915 | Tower | 292/36 |
| 1,204,221 | 11/1916 | Williams | 114/201 R |
| 1,964,114 | 6/1934 | Gerlach et al. | 292/36 |
| 2,447,042 | 8/1948 | Velie | 220/55 |
| 2,447,464 | 8/1948 | Jenkins | 292/6 |
| 2,772,809 | 12/1956 | Ross | 292/7 |
| 2,793,892 | 5/1957 | Hutterer | 292/36 |
| 3,051,280 | 8/1962 | Bergmani | 292/48 |
| 3,861,083 | 1/1975 | Goiot | 114/203 |
| 4,020,778 | 5/1977 | Sutton | 114/203 |
| 4,073,239 | 2/1978 | Adler | 114/203 |
| 4,273,064 | 6/1981 | Sutton | 114/203 |
| 4,750,569 | 6/1988 | Flogaus | 292/48 |

*Primary Examiner*—Joseph F. Peters, Jr.
*Assistant Examiner*—Clifford T. Bartz
*Attorney, Agent, or Firm*—Mark G. Kachigian

[57] ABSTRACT

A cover for a hatch which will engage with a rim to produce a water tight seal. The hatch cover includes a plate capable of seating in the rim and a shaft extending vertically through an aperture in the plate and slidably received therein. A handle is located on one side of the plate, one end of the handle pivotally connected to the shaft so that the handle will move from a closed position parallel to the plate to an open position substantially perpendicular to the plate. The handle imparts vertical movement to the shaft with respect to the plate. Arm assemblies extend radially outward from the shaft on the side of the plate opposite the handle, whereby movement of the handle imparts movement to the arm assemblies thereby extending the arm assemblies to engage the rim.

5 Claims, 4 Drawing Sheets

HATCH COVER

BACKGROUND OF THE INVENTION

1. Field of the Invention

The present invention relates to a novel cover for a hatch that may be engaged with a rim for a water tight seal.

2. Prior Art

Various hatch covers that will sealably engage with a rim are known in the prior art. Many of these hatch covers are used in commercial fishing and other vessels and are subject to wear from salt water and other conditions. A hatch cover for use under these conditions should ideally be simple in operation, require little maintenance, and be capable of sealing tightly with a rim.

A patentability search was conducted on the above invention and the folowing references were uncovered.

| U.S. PAT. NO. | PATENTEE | ISSUE DATE |
|---|---|---|
| 4,020,778 | Sutton | May 3, 1977 |
| 991,548 | Schmid | May 9, 1911 |
| 2,447,464 | Jenkins | August 17, 1968 |
| 4,273,064 | Sutton | June 16, 1981 |
| 255,017 | Pond | March 14, 1882 |
| 695,409 | Mandt | March 11, 1902 |
| 891,174 | Hurlburt | June 16, 1908 |
| 1,136,498 | Tower | April 20, 1915 |
| 1,204,221 | Williams | November 7, 1916 |
| 1,964,114 | Gerlach et al. | June 26, 1934 |
| 2,447,042 | Velie | August 17, 1948 |
| 2,793,892 | Hutterer | May 28, 1957 |

Schmid (U.S. Pat. No. 991,548) discloses a door handle which rotates a rotary member disk. As the disk is rotated, arms attached to the disk are either extended or retracted.

The Sutton references (U.S. Pat. Nos. 4,020,778 and 4,273,064) disclose a cover having a rotatable shaft as the shaft rotates, vertical movement is imported to the arms to pry against the rim through the use of camming means.

Jenkins (U.S. Pat. No. 2,447,464) provides a hinged door with a threaded shaft that moves bars on the same side as the handle about lugs that act as levers.

Pond (U.S. Pat. No. 255,017) discloses a handle that moves from a closed position parallel to the plate to an open position perpendicular to the plate which, in turn, moves a pair of arms outward toward the rim.

Mandt (U.S. No. 695,409) provides a handle attached to a transverse crank shaft that moves arms in order to engage apertures provided in cleats.

Hurlburt (U.S. Pat. No. 891,174) shows a pair of handles that are pivotally connected to a plate in order to move hooks underneath a plate that engage a rim.

Tower (U.S. Pat. No. 1,136,498) discloses levers moved by a handle which withdraw bolts from a door frame.

Williams (U.S. Pat. No. 1,204,221) provides articulated arms that are urged toward a rim by a spring and retracted through use of a handle.

Gerlach et al. (U.S. Pat. No. 1,964,114) discloses a handle that rotates a pivot member which extends and retracts rods which are connected eccentrically to the pivot member.

Velie (U.S. Pat. No. 2,447,042) discloses a plate with an outer convex bearing wherein levers are radially disposed and passed through U-shaped guy rods. An operating lever connected to a shaft rocks cam plates which, in turn, move the levers radially outward or inward.

Hutterer (U.S. Pat. No. 2,793,892) provides a handle which is rotatably mounted on a pivot in order to move a hub which either extends or retracts latch bolts.

Accordingly, it is a principal object and purpose of the present invention to provide a hatch cover that will seal tightly with a rim, be simple in operation, and require little maintenance.

SUMMARY OF THE INVENTION

A hatch cover is provided to engage with a rim to produce a water tight seal. The hatch cover includes a cover plate with a handle located on the top side of the cover plate. When moved from a position parallel to the cover plate, the handle imparts movement to a shaft that is slidably received in an aperture in the cover plate.

The shaft extends through the cover plate. Extending radially from the shaft on the opposite side of the cover plate is a spider which has a central cylindrical opening to receive the shaft and a plurality of extending legs.

Extending radially from each leg of the spider is an arcuate inner arm. Extending radially from each inner arm is an outer arm. Each outer arm passes through a guide tower secured to the cover plate.

When in the closed position, the end of each outer arm pries against the rim.

In order to open the hatch cover, the handle is moved from a position parallel to the cover plate toward the vertical position. The shaft moves through the cover plate, causing the spider to move away from the cover plate. As the spider moves, it causes the ends of the inner arms to move in an arc so that the outer arms will retract towards the shaft and away from the rim.

DETAILED DESCRIPTION OF THE PREFERRED EMBODIMENTS

Figure 1:
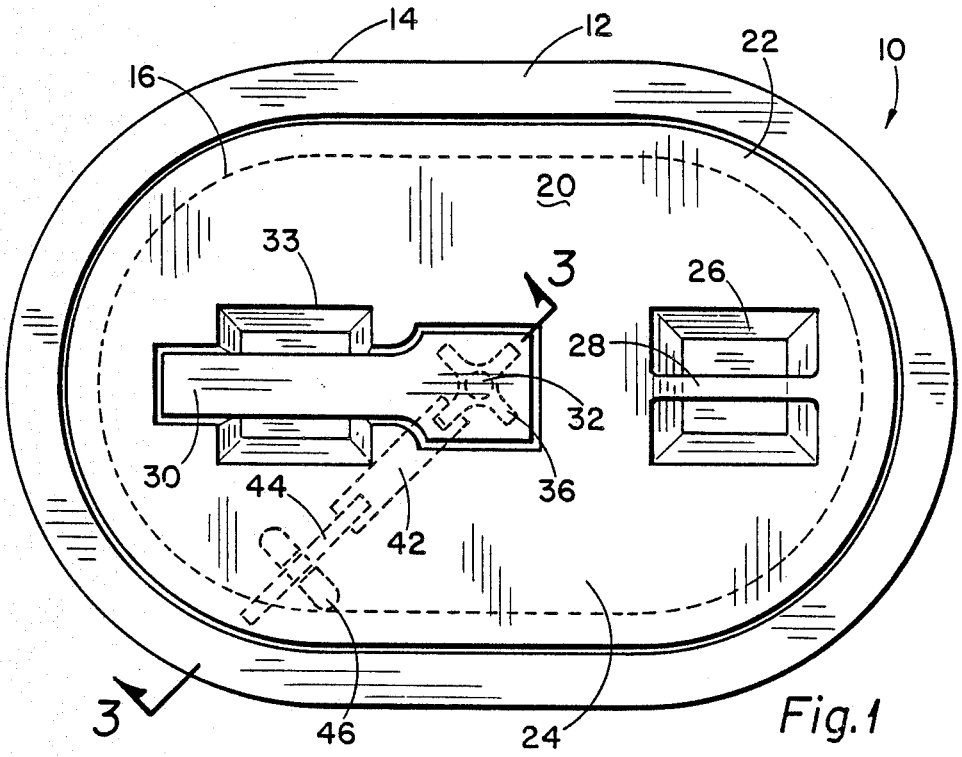
FIG. 1 is a top view of a hatch cover in the closed position constructed in accordance with the present invention.

Referring to the drawings in detail, FIG. 1 shows a top view of a hatch cover 10 which seats in a continuous rim 12. As will be described, the hatch cover engages with the rim to close an opening and produce a water tight seal. When disengaged from the rim, the hatch cover may be lifted off. The hatch cover of the present invention has a number of uses including, but not limited to, use on the deck of a commercial fishing vessel.

The rim 12 has an outer lip 14 and an inner lip 16 (shown in dashed line in FIG. 1). It should be understood that the rim may take other configurations so long as it has a protruding lip. The rim itself will rest on and be secured to a opening provided in a floor or deck (not shown).

The hatch cover includes a cover plate 20. In the embodiment shown, the cover plate has an oval shaped circumferential edge 22, however, the edge may take a variety of shapes, such as circular or rectangular. The cover plate 20 has a top side 24 visible in FIG. 1. A portion of the cover plate 20 is recessed at grip pocket 26. Combined with a hand grip 28, which extends across the top of the pocket in a plane with the cover plate, the hatch cover 10 may be held and lifted off and away from the rim 12. The hand grip is, thus, flush with the top side 24 of the cover plate so as to provide a smooth surface. When used on a deck, the hatch cover may be stepped on or over without fear of tripping or injury.

A handle 30 is located on the top side 24 of the cover plate. As will be described herein, the handle may be moved in order to engage or disengage the hatch cover 10 from the rim 12. The handle is connected and imparts movement to a shaft 32 (shown in dashed lines in FIG. 1) that is slidably received in a aperture in the cover plate. The cover plate 20 includes a recess at handle pocket 33. Sufficient clearance is provided between the handle 30 and the handle pocket 33 to allow fingers to easily grasp the handle when in the closed position.

In FIG. 1, the handle 30 is in the closed position, the hatch cover being engaged with the rim to provide a water tight seal. When in the closed position, the handle is parallel to the cover plate.

Figure 2:
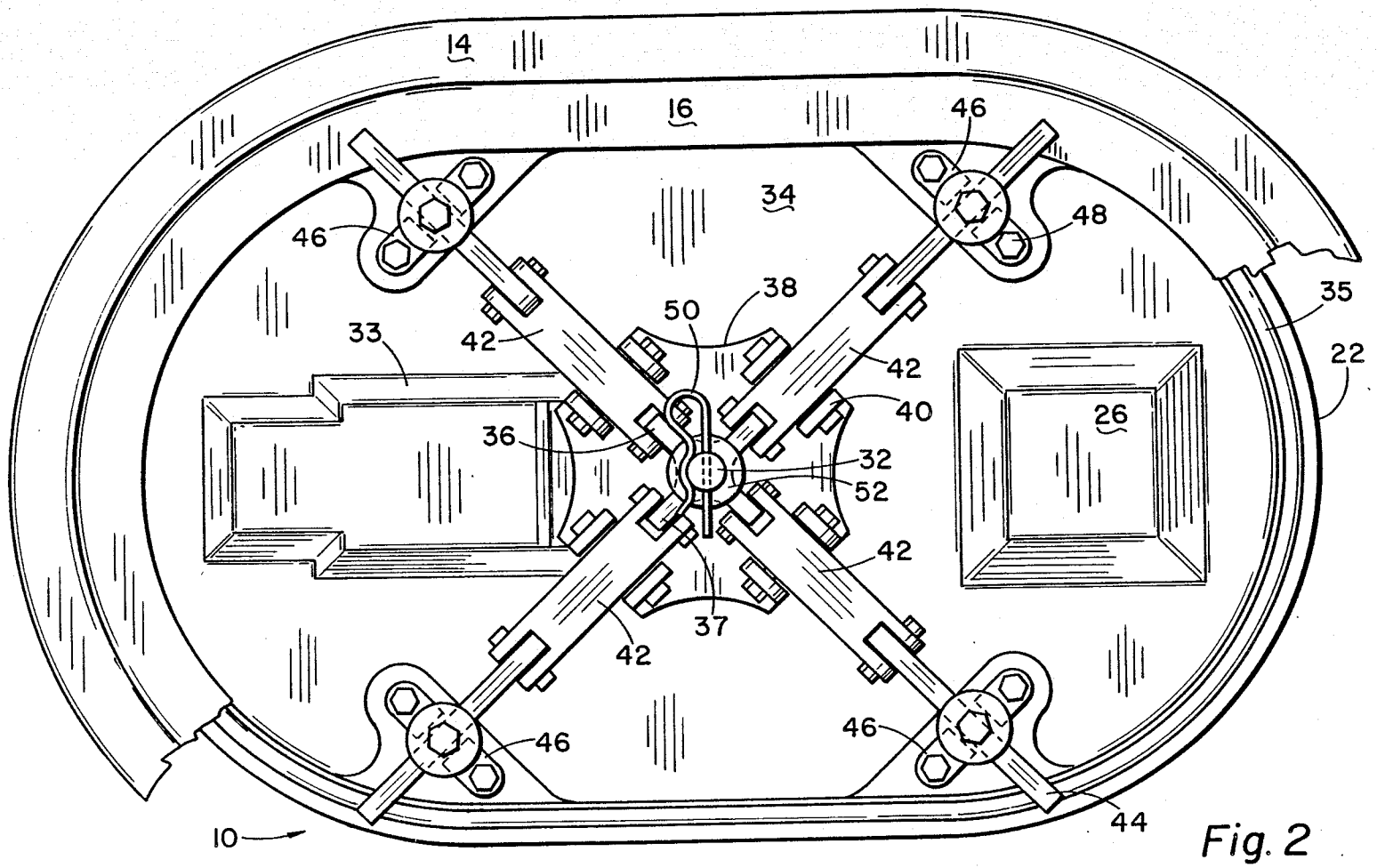
FIG. 2 is a bottom view of the hatch cover shown in FIG. 1.

FIG. 2 is a bottom view of the hatch cover 10 seen in FIG. 1. The shaft 32 extends through the cover plate and through the bottom side 34 of the cover plate. Near the edge 22 of the bottom side 34 is a continuous rubber gasket 35 which is visible where the rim 12 has been cut away. When the hatch is in place on the rim, the rubber gasket rests against the inner lip 16 of the rim to assist in maintaining a water tight seal.

Extending radially from the end of the shaft 32 is a spider 36 which has a central cylindrical opening to receive the shaft and a plurality of extending legs 37. Surrounding the shaft 32 and attached to the bottom side 34 of the cover plate is a center hub 38 which has a plurality of ears 40.

Extending radially from and pivotally connected to each leg of the spider is an inner, arcuate arm 42. Extending radially from each inner arm 42 is an outer arm 44. Each outer arm 44 passes through a guide tower 46 secured to the cover plate by screws 48. When in the closed position, as in FIGS. 1 and 2, the end of each outer arm pries against the inner lip 16 of the rim 12. Each leg 37 of the spider, inner arm 42, and outer arm 44 together constitute an arm assembly that extends radially from the shaft. Although four sets of arm assemblies are utilized in the present embodiment, it should be understood that a greater or lesser number might be employed.

The underside of the grip pocket 26 and handle pocket 33 are also seen in FIG. 2.

If someone is accidentally trapped beneath the hatch cover when it is in the closed position, a safety feature is provided. Cotter pin 50 received in an aperture (not shown) at the end of the shaft 32 may be removed by pulling. This will allow washer 52, which holds spider 36 in place against shoulder 53, to slip off of the shaft. As the spider is moved off of the shaft and away from the cover plate, the outer arms will be retracted from the rim and disengaged therefrom. The hatch cover could then be pushed off and away from the rim to allow the trapped person to exit.

Figure 3:
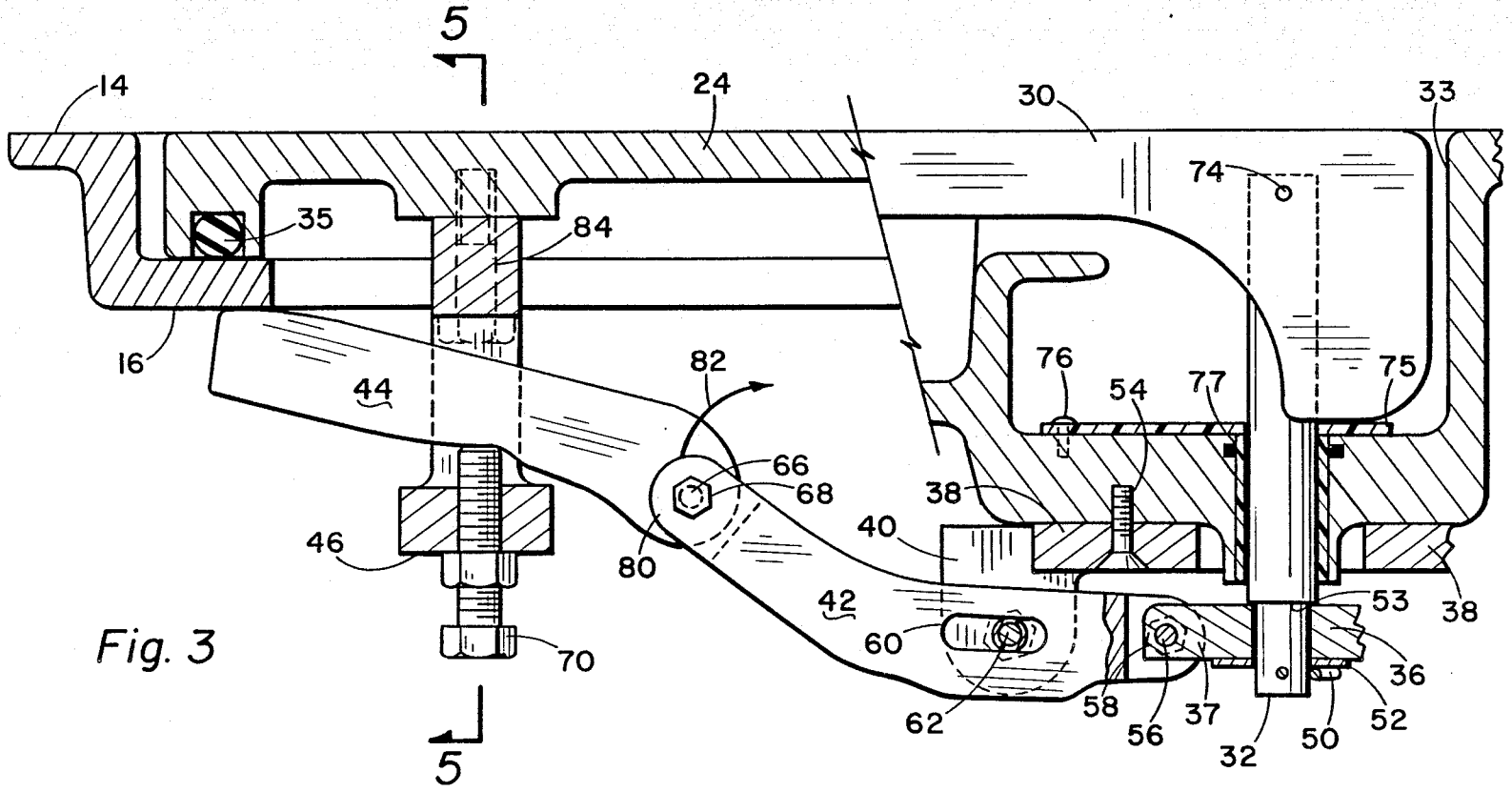
FIG. 3 is a sectional view of the hatch cover shown in FIG. 1 taken along section lines 3—3.

FIG. 3 also shows the closed position of the hatch cover 10. As can be readily seen, the top 24 of the cover plate 20 is flush with the outer lip 14 of the rim so that a smooth surface is provided with no protruding areas.

The rubber gasket 35 on the bottom side 34 of the cover plate rests on the lower lip 16 of the rim to assist in maintaining a water tight seal. As arranged, there is both a metal-to-metal contact and a rubber-to-metal contact.

The handle 30 is recessed at handle pocket 33 so that the handle is flush with the top 24 of the cover plate so that a smooth surface is provided.

The center hub 38 may be secured to the bottom side 34 of the hatch cover by any conventional means such as screws 54. Each leg 37 of the spider 36 has an opening near its end to receive a bolt 56 and nut 58 in order to pivotally hold the inner arm 42 in place.

The arcuate shape of each inner arm 42 can be observed. Each inner arm 42 also has a longitudinal slot 60 through which is received a bolt 62 held in place by a pair of ears 40. As the spider is moved by the shaft, the inner arm will move, although the bolt will remain stationery.

Each inner arm 42 is allowed to pivot and articulate with respect to the outer arm 44 through use of a bolt 66 and nut 68.

When in the closed position seen in FIG. 3, the outer arm 44 is at the greatest distance from the shaft 32. The spider 36 will be located at a position closest to the cover plate 20. Conversely, when in the open position, the spider will be in a position furthest from the cover plate; the outer arm will be closer to the shaft.

As can be observed in FIG. 3, the outer arm 44 is at an angle with respect to the inner lip 16. The guide tower 46 allows adjustment of the pressure of the outer arm against the lip 16 through an adjustable bolt 70 received in a threaded opening in the guide tower 46. The bolt 70 acts as a fulcrum of a lever and the pressure of the outer arm against the inner lip 16 may, thus, be varied.

Returning to a consideration of the shaft and handle, a roll pin 74 connects the handle 30 to the shaft 32. The end of the handle 30 is allowed to slide on a plastic plate 75 as it moves between the closed position parallel to the plate and open position. The plate 75 is secured by screws 76. An O-ring 77 around the circumference of the shaft prevents water from entering the aperture where the shaft 32 is received through the cover plate.

Figure 4:
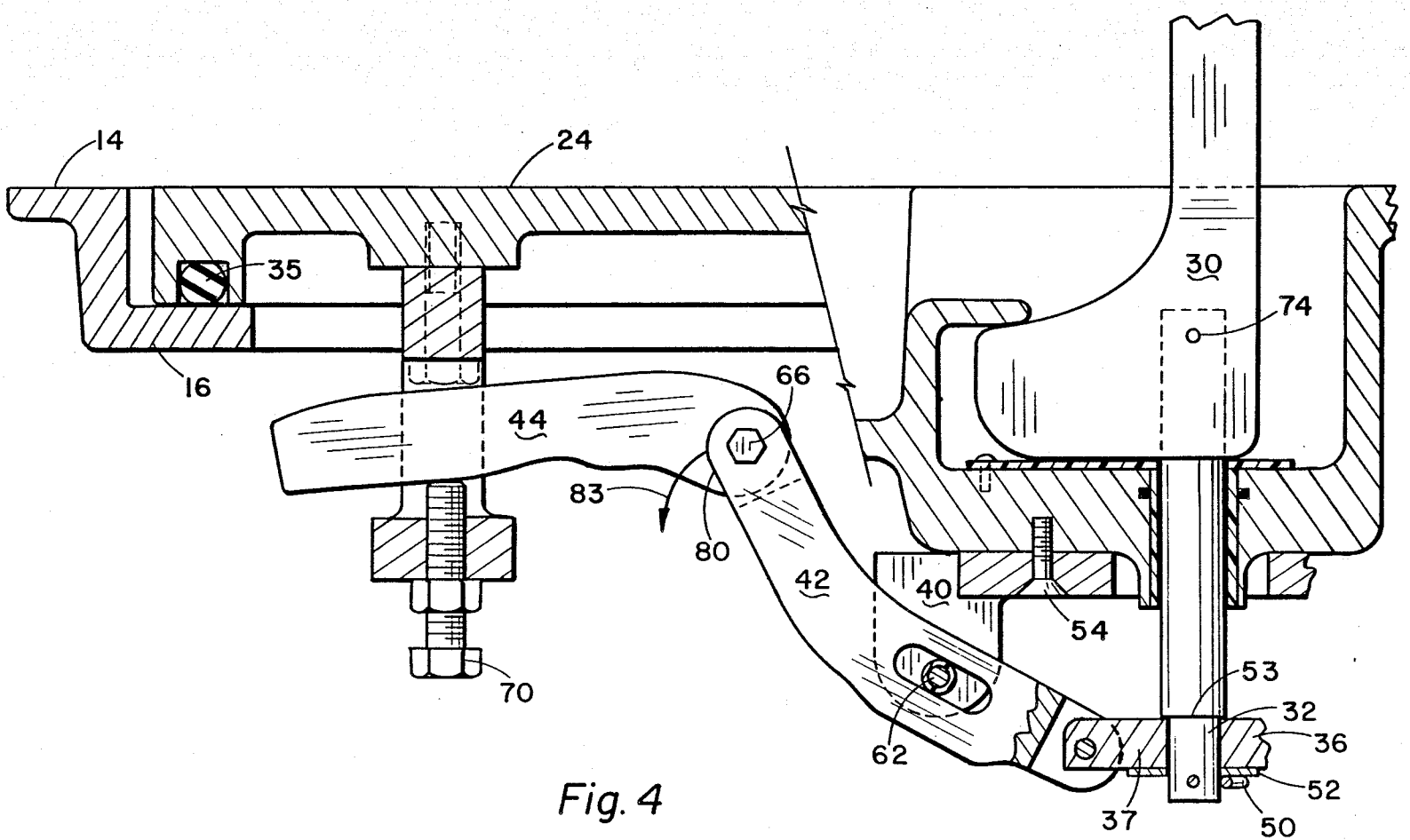
FIG. 4 is a sectional view of the hatch cover shown in FIG. 1 in the open position.

FIG. 4 shows the open position of the hatch cover disengaged from the rim. The handle 30 is in a vertical position with respect to the cover plate. When the hatch cover is desired to be opened, the handle will be gripped and pulled. As the handle is moved toward the vertical position, the shaft 32 will move through the cover plate, causing the spider 36 to move away from the cover plate.

As the spider moves, it causes the end 80 of each inner arm 42 where bolt 66 and nut 68 are located to move in an arc as seen by the arrows 82 and 83 in both FIGS. 3 and 4. The arrow 82 in FIG. 3 indicates the movement going from a closed position to an open position. The arrow 83 in FIG. 4 indicates the movement going from an open position to a closed position. The movement of the end 80 of each inner arm 42, thus, has two components: upward towards the plate and inward towards the shaft.

The movement of the inner arm 42 causes the outer arm 44 to retract towards the shaft 32 and, with bolt 70 acting as a fulcrum, to move away from the lip 16 of the rim 12.

Figure 5:
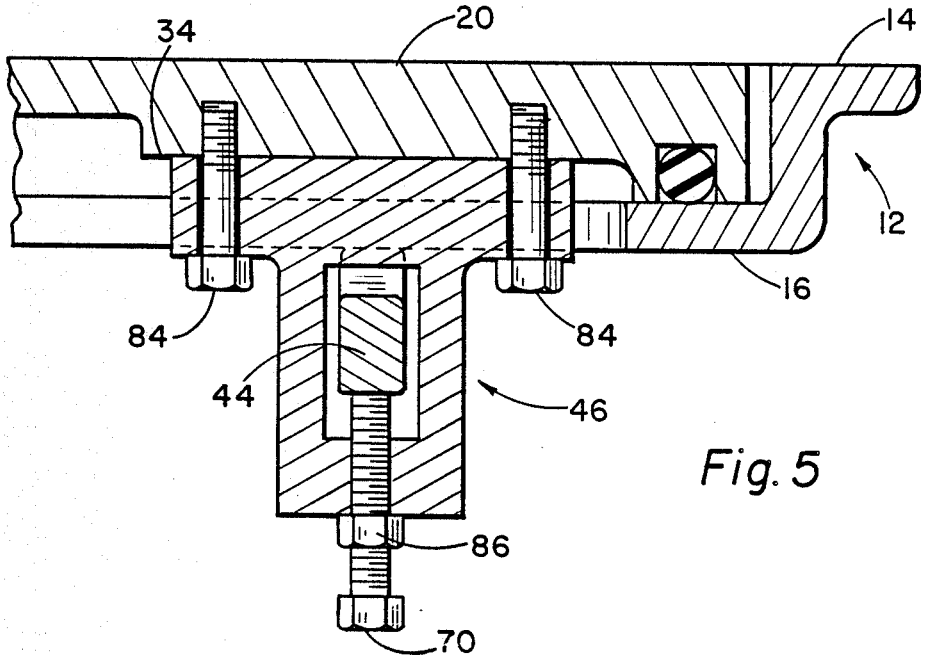
FIG. 5 is a sectional view of the hatch cover shown in FIG. 3 taken along section line 5—5.

FIG. 5 shows a sectional view of one of the guide towers 46 which are secured to the cover plate by bolts 84 threadably received in the bottom 34 of the cover plate. A nut 86 aids in adjustment of the position of the bolt 70.

In order to open the hatch, the handle is grasped and pulled until it is in the vertical position seen in FIG. 4. No turning or rotating of the handle is required. The position of the handle serves as a visible indicator of whether the hatch is open or closed. Holding the handle 30 in one hand and the grip 28 in the other, the hatch cover may be easily lifted.

In order to close the hatch, the reverse operation is performed.

Whereas the present invention has been described in relation to the drawings attached hereto, it should be understood that other and further modifications, apart from those shown or suggested herein, may be made within the spirit and scope of this invention.

What is claimed is:

1. A cover for a hatch which cover will engage with a rim to produce a water tight seal, which comprises:

a. a plate capable of seating in said rim:

b. a shaft extending vertically through an aperture in said plate and slidably received the rein:

c. handle means on one size of said plate, one end of said handle means pivotally connected to said shaft to move said handle from a closed position parallel to said plate to an open position substantially perpendicular to said plate where by said handle means may impart vertical movement to said shaft with respect to said plate; and d. a plurality of arm assemblies extending radially outward from said shaft on the size of said plate opposite said handle, whereby movement of said handle vertically moves said shaft which imparts movement to said arm assemblies, thereby extending or retracting said arm assemblies to engage with or disengage from said rim.

2. A cover for a hatch as set forth in claim 1 wherein said plate has a recessed portion for said handle means and wherein said handle means is flush with the top of said plate when in said closed position.

3. A cover for a hatch as set forth in claim 1 including means to pivotally connect said shaft to said arm assemblies and wherein each arm assembly includes an inner arm extending from said pivot means and an outer arm articulated to and extending from said inner arm.

4. A cover for a hatch as set forth in claim 3 including a plurality of guide towers on said plate which receive said arms therethrough.

5. A cover for a hatch as set forth in claim 4 wherein the end of each said inner arm which is connected to each said outer arm moves in an arcuate path.

* * * * *